US006536976B1

(12) United States Patent
Konose

(10) Patent No.: US 6,536,976 B1
(45) Date of Patent: Mar. 25, 2003

(54) WRITING INSTRUMENT

(75) Inventor: Yoshiomi Konose, Gunma (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/979,026

(22) PCT Filed: May 16, 2000

(86) PCT No.: PCT/JP00/03137

§ 371 (c)(1),
(2), (4) Date: Nov. 15, 2001

(87) PCT Pub. No.: WO00/69655

PCT Pub. Date: Nov. 23, 2000

(30) Foreign Application Priority Data

May 17, 1999 (JP) ..... 11-35971

(51) Int. Cl.[7] ..... B43K 5/02; B43K 5/18

(52) U.S. Cl. ..... 401/198; 401/223; 401/224; 401/227; 401/228; 401/237; 401/242

(58) Field of Search ..... 401/198, 223, 401/224, 225, 226, 227, 237, 242, 228

(56) References Cited

U.S. PATENT DOCUMENTS 5,372,445 A 12/1994 Mutschler

FOREIGN PATENT DOCUMENTS

| | | |
|---|---|---|
| JP | 59-153178 | 10/1984 |
| JP | 1-10236 | 3/1989 |
| JP | 3-31580 | 7/1991 |

OTHER PUBLICATIONS

Translated International Preliminary Examination Report dated Feb. 21, 2002.

*Primary Examiner*—Gregory Huson
*Assistant Examiner*—Kathleen J. Prunner
(74) *Attorney, Agent, or Firm*—Burns, Doane, Swecker & Mathis, LLP

(57) ABSTRACT

The object is to provide a writing instrument in which a large-diametric ink retaining portion with narrow grooves in width and still capable of securing a large enough air channel can be formed so that the replacement of the sufficient amount of air can be effected between the ink retaining portion and the outside air. To achieve this, in an ink retaining portion (12), a plurality of cutouts (32) are formed so that each cutout (32) is formed to a right angle direction with respect to a center line (16*a*) of the sheet element (16) with a length equal to or greater than half the radius (R) (A≧(R/2), B≧(R/2)) and that one end of the cutout (32) is extended to the periphery.

1 Claim, 5 Drawing Sheets

WRITING INSTRUMENT

TECHNICAL FIELD

The present invention relates to a writing instrument with an ink reservoir having an ink retaining portion for temporarily storing ink in accordance with change in the pressure inside the ink tank.

BACKGROUND ART

There are writing instruments having an ink retaining portion in its ink reservoir for temporarily storing ink in accordance with change in the pressure inside the ink tank.

A typical writing instrument, as disclosed in Japanese Utility Model Application Laid-Open Sho No.58-21474 and others, has a temporary ink retaining portion in front of an ink tank. This ink retaining portion is called 'Jabara (bellows)' and is formed of a multiple number of disk-like sheet elements arranged at intervals inside the barrel like a comb when sectionally viewed so that ink can be temporarily stored in the gaps between these sheet elements.

In the temporary ink retaining portion used in such a writing instrument, as sectionally shown in FIG. 1, the ink retaining portion is comprised of a multiple number of disk-like sheet elements 'a' arranged in layers so that the spacing between layered sheet elements 'a' will serve as ink retaining grooves. This ink retaining portion is fitted into a barrel cylinder 'b' and has a cutout portion 'd' formed in the rectangle direction with respect to the center line 'c' so as to create an air channel for establishing communication between the ink retaining portion and the outside air. In FIG. 1, a reference code 'e' designates a common base of multiple sheet elements 'a' as sectionally viewed and having a bore allowing an intermediary ink core 'f' to fit therein. Designated at 'g' is an ink conduit groove (slit) which establishes communication from an unillustrated tank to the ink retaining grooves so as to lead ink.

However, with the above-described conventional ink retaining portion, there have been cases where air replacement might be poor because the size of the cutout (air channel) is not large enough.

Further, when this ink retaining portion is formed by injection molding, the metal die element for molding is thin and sheet-like. Therefore, there has been a fear that the sheet-like metal die elements may give way or break as a result of the pressure arising when the resin is injected and it has been also difficult to produce an ink retaining portion having a large diameter.

The present invention has been devised in view of the above conventional problems and it is therefore an object of the present invention to provide a writing instrument in which a large-diametric ink retaining portion with air grooves small in width and still capable of securing a large enough air channel can be formed so that a sufficient amount of air will be able to be displaced between the ink retaining portion and the outside air.

DISCLOSURE OF THE INVENTION

The present invention has the following configuration in order to solve the above-mentioned problem.

The first aspect of the present invention resides in a writing instrument with an ink retaining portion for temporarily holding ink in accordance with change in the pressure inside the ink tank, comprising: a reservoir formed of sheet elements arranged at intervals in layers, wherein each sheet element is formed with a cutout which is formed to a right angle direction with respect to the center line of the sheet element and has a length equal to or greater than half the radius with one end extended to the periphery.

According to the configuration of the present invention, the following effect can be obtained.

According to the first configuration of the present invention, each sheet element is formed with the cutout which is formed to the right angle direction with respect to the center line of the sheet element and has a length equal to or greater than half the radius with one end extended to the periphery. Therefore, the forming die element of the cutout functions as the supporting bridge across the forming die elements for the grooves between sheet elements of the ink retaining portion, hence even if the cutout die element is large, no deficiency such as the mold yielding will occur when injection molding is performed.

BEST MODE FOR CARRYING OUT THE INVENTION

The embodiment of the present invention will be described with reference to the drawings.

Figure 1:
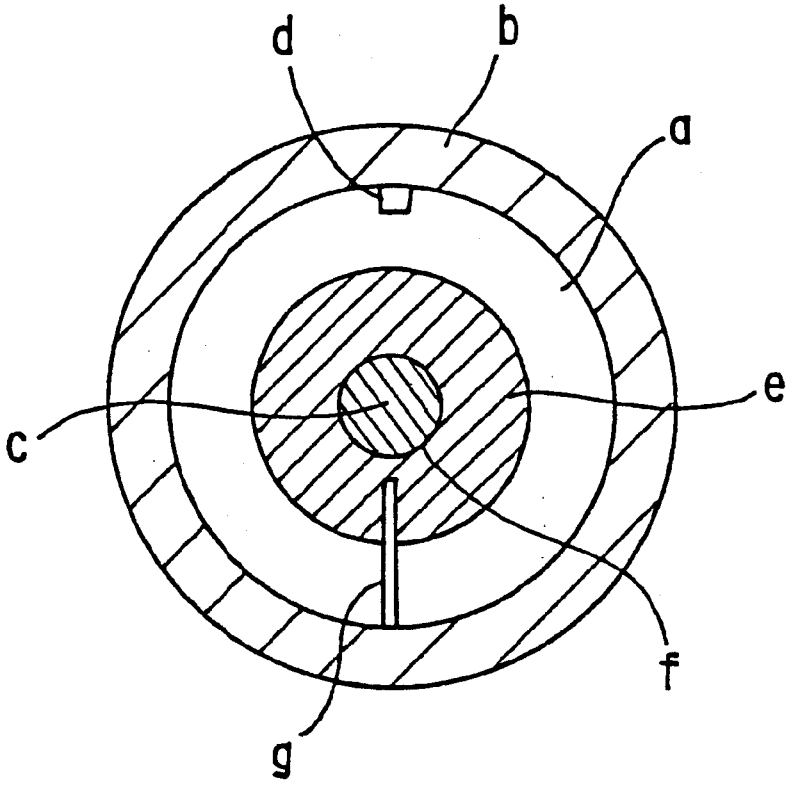
FIG. 1 PRIOR ART
FIG. 1 is a cross section of a conventional ink retaining portion.
Figure 2:
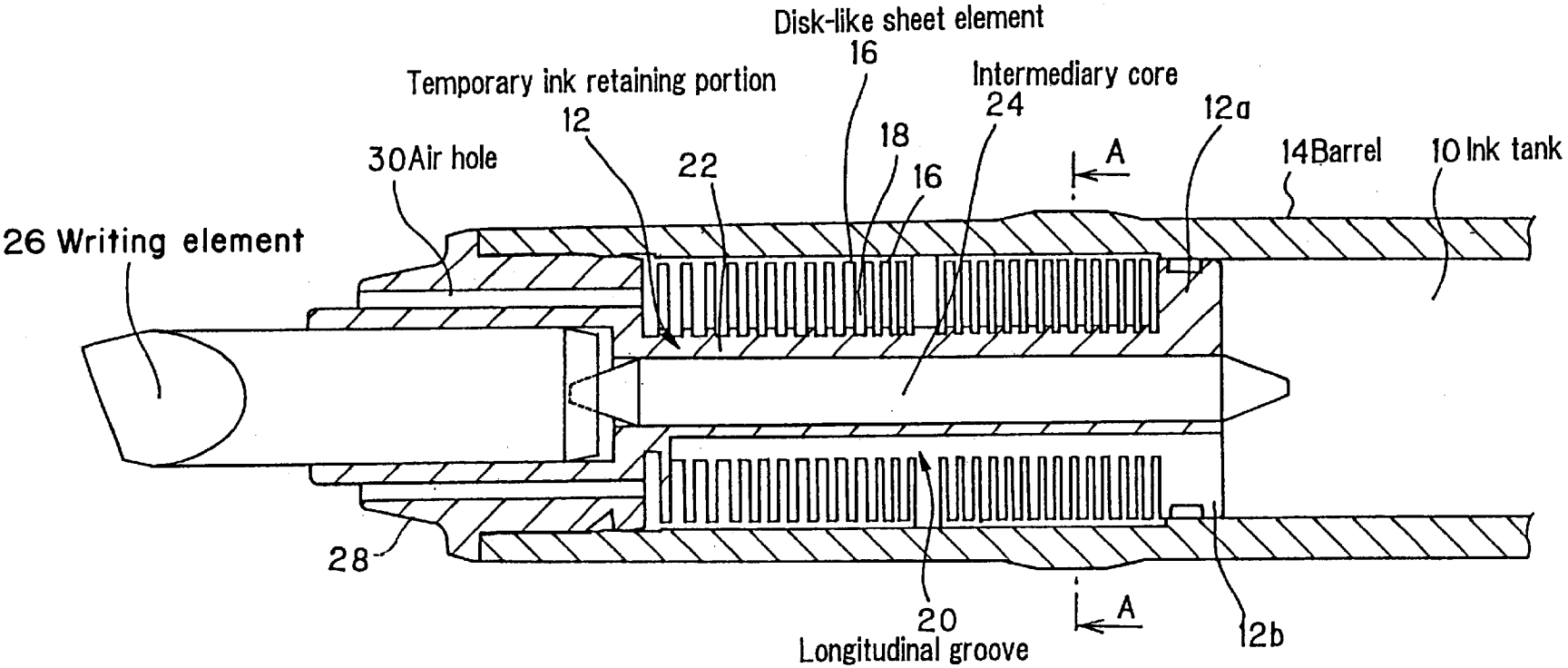
FIG. 2 is a vertical section of a writing instrument according to embodiment 1.
Figure 3:
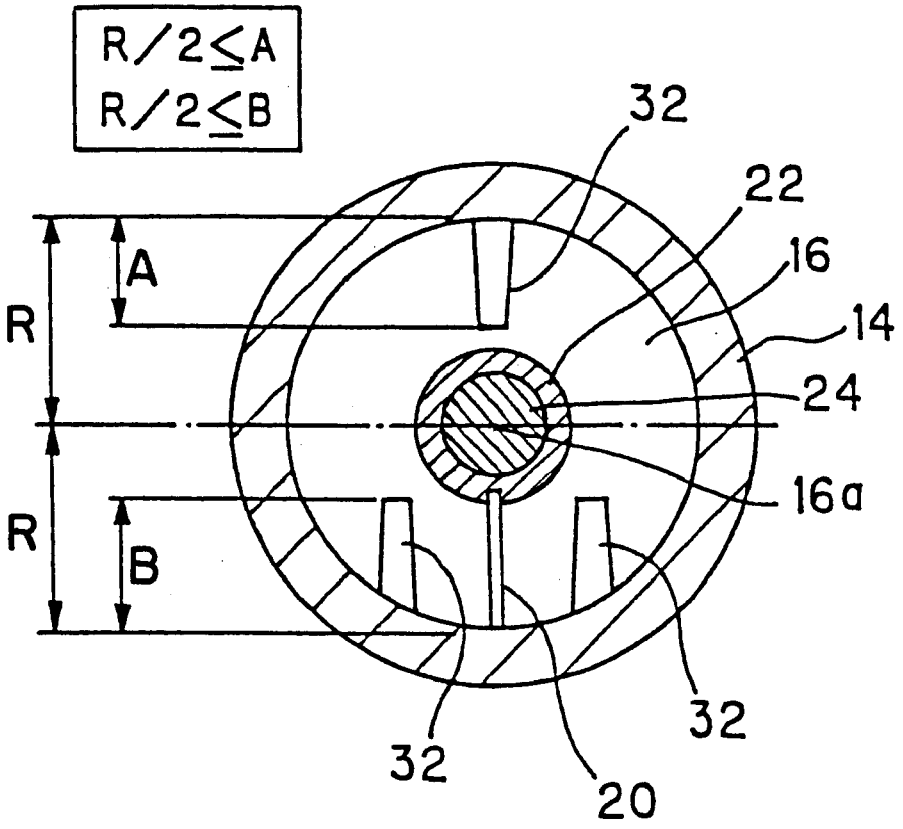
FIG. 3 is a cross section taken along a line A—A in FIG. 2.

FIG. 2 is a vertical section of a writing instrument according to embodiment 1 and FIG. 3 is a cross section taken along a line A—A.

This writing instrument has an ink retaining portion 12 in front of an ink tank 10. Ink retaining portion 12 temporarily stores ink in accordance with change in the pressure inside ink tank 10.

Ink retaining portion 12 is configured of a thick disk-like rear end part 12*a* with its outer periphery water-tightly fitted in a barrel (barrel cylinder) 14 and a multiple number of thin disk-like sheet elements 16 arranged in layers in front of the rear end part 12*a*, thus forming ink retaining grooves (transversal grooves) 18 for storing ink between these sheet elements 16 by capillarity.

Sheet elements 16 are formed with a slit-like ink feed groove (longitudinal groove) 20 (FIGS. 2 and 3) formed perpendicularly to the longitudinal axis of barrel 14. This ink feed groove (longitudinal groove) 20 has a groove width smaller than that of any of ink retaining grooves (transversal grooves) 18, hence is always filled up with ink so that overflow ink can be fed directly to ink retaining grooves (transversal grooves) 18 as soon as the pressure inside the ink tank increases. This ink feed groove 20 is formed across all the sheet elements 16 and continuously extended to ink tank 10 through an opening groove 12*b* at the aforementioned rear end part 12*a*. This opening groove 12*b* of rear end part 12*a* opens into ink tank 10 and is formed to a width that will provide a certain capillary force.

Ink retaining portion 12 is configured so that layered sheet elements 16 are fixed and supported at their center by a hollow cylindrical element 22. Fitted inside this hollow cylindrical element 22 is an intermediary core 24 made up of a fiber bundle. This intermediary core 24 feeds ink from ink tank 10 to a writing element 26 disposed at the front end of barrel 14.

A holder 28 for fixing and holding writing element 26 at the front end of barrel 14 has air holes 30 formed parallel to writing element 26 for establishing communication between the outside and ink retaining portion 12 inside barrel 14.

One or multiple cutouts 32 (FIG. 3) are formed on the periphery of each sheet element 16. In the layered sheet elements 16 cutouts 32 are aligned at the same position so that cutouts 32 in alignment form an air channel. This air channel is so formed with a width that is greater than the maximum groove width above which a liquid film cannot be formed by the surface tension of ink or any other liquid. For communication with the outside, air can be led into, and out of, ink retaining grooves 18 between sheet elements 16, through the air channel continuously formed of air hole 30 and cutouts 32.

As shown in FIG. 3, a plurality of cutouts 32 of the sheet element 16 are formed so that each cutout 32 is formed to right angle direction with respect to a center line 16*a* of the sheet element with a length equal to or greater than half the radius R which is the length from the center line 16*a* to the periphery ($A \geqq (R/2)$, $B \geqq (R/2)$) and one end of the cutout 32 is extended to the periphery. In embodiment 1, two cutouts 32 are formed in parallel with ink feed groove 20 in-between and one cutout 32 is formed on the opposite side with respect to intermediary core 24, that is, three cutouts 32 are formed in total.

Therefore, according to the writing instrument of the present embodiment, since the forming die elements of cutouts 32 function as the supporting bridges across the forming die elements for ink retaining grooves 18 between sheet elements 16, even if the die elements for cutouts 32 are large, no deficiency such as the mold yielding will occur when injection molding is performed.

Thus, it is possible to provide an ink retaining portion 12 with large-diametric sheet elements 16 arranged with narrow groove widths therebetween, still having a large air channel secured so that the replacement of the sufficient air can be effected between ink retaining portion 12 and the outside air.

Figure 4:
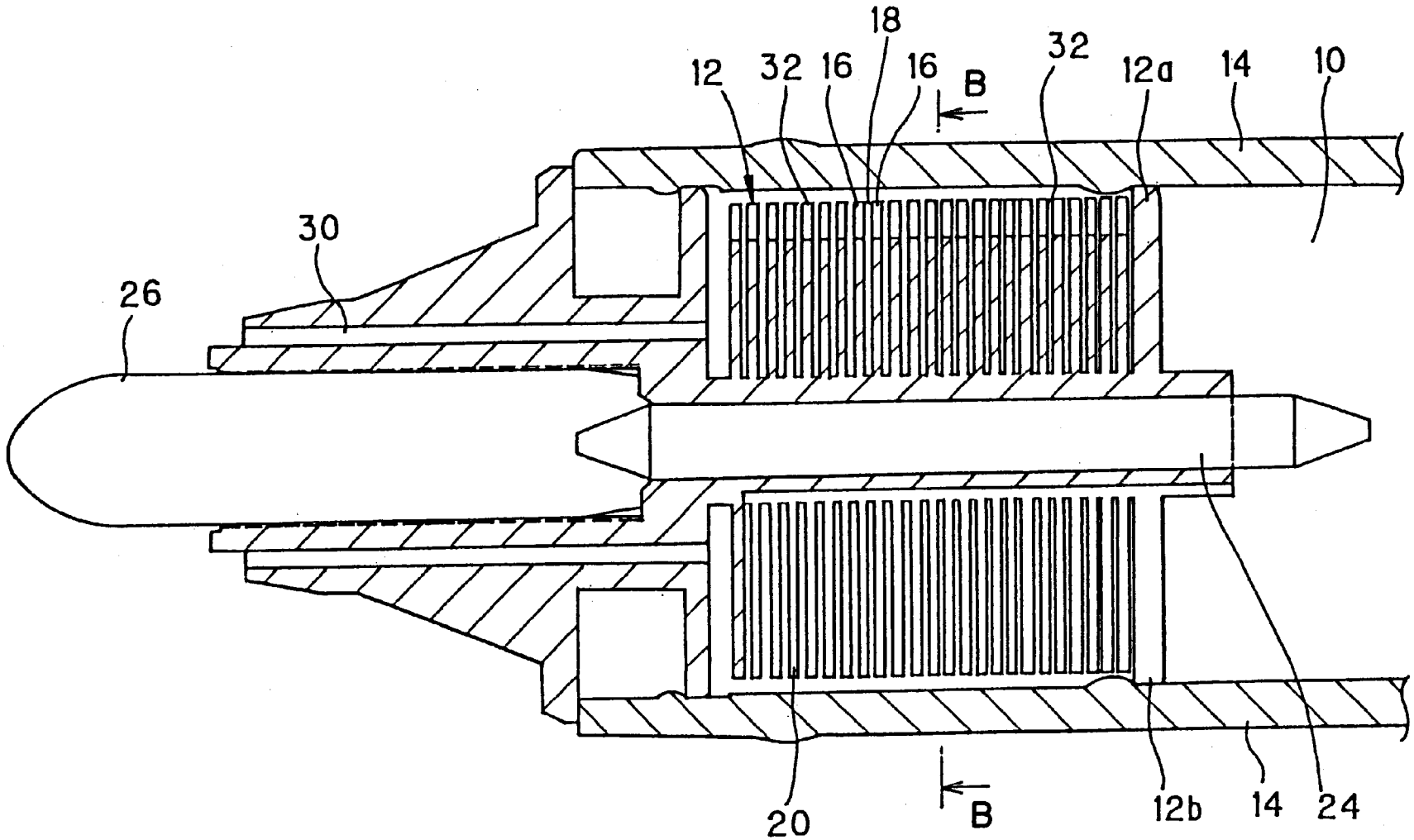
FIG. 4 is a vertical section of a writing instrument according to embodiment 2.
Figure 5:
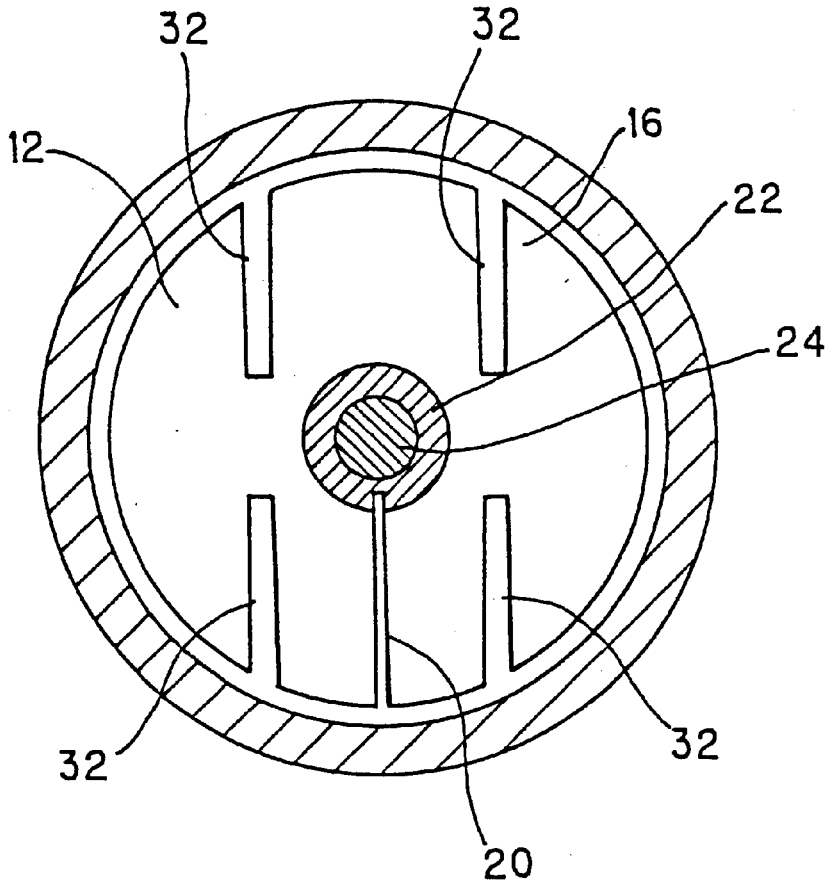
FIG. 5 is a cross section taken along a line B—B in FIG. 4.

The present invention is not limited to embodiment 1, but as shown in embodiment 2 of FIGS. 4 and 5, two cutouts 32 may be formed in parallel with ink feed groove 20 in-between, also two cutouts may be formed with on the opposite side with respect to intermediary core 24, that is, four cutouts in total may be formed.

As has been described, according to the present invention, it is possible to form a large-diametric ink retaining portion with narrow grooves in width and still capable of securing a large enough air channel so that the replacement of the sufficient air can be effected between the ink retaining portion and the outside air.

INDUSTRIAL APPLICABILITY

As mentioned above, the present invention is suitable for a writing instrument in which a large-diametric ink retaining portion with air grooves small in width and still capable of securing a large enough air channel can be formed so that the replacement of the sufficient amount of air will be effected between the ink retaining portion and the outside air.

What is claimed is:

1. A writing instrument with an ink retaining portion for temporarily holding ink in accordance with a change in the pressure inside an ink tank, comprising:

the retaining portion being formed of sheet elements arranged at intervals in layers, wherein each sheet element is formed with cutouts each of which is formed to a right angle direction with respect to a center line of the sheet element and has a length equal to or greater than half the radius of the sheet element with one end extended to an outer periphery of the sheet element, the cutouts comprising first cutouts formed at two or more sites, parallel to each other with an ink feed groove in between and at least one second cutout formed on an opposite side of the first cutouts with respect to an intermediary core.

* * * * *